US008061790B2

(12) United States Patent
Anikhindi et al.

(10) Patent No.: US 8,061,790 B2
(45) Date of Patent: Nov. 22, 2011

(54) POWERED DRAWER FOR AN APPLIANCE

(75) Inventors: Sanjay Manohar Anikhindi, Karnataka (IN); Mark W. Wilson, Simpsonville, KY (US); Solomon Muthumani, Andhra Pradesh (IN)

(73) Assignee: General Electric Company, Schenectady, NY (US)

( * ) Notice: Subject to any disclaimer, the term of this patent is extended or adjusted under 35 U.S.C. 154(b) by 883 days.

(21) Appl. No.: 11/962,074

(22) Filed: Dec. 20, 2007

(65) Prior Publication Data

US 2009/0160297 A1 Jun. 25, 2009

(51) Int. Cl.
*A47B 96/04* (2006.01)

(52) U.S. Cl. ..... 312/402; 312/319.5

(58) Field of Classification Search ..... 312/330.1, 312/319.5, 319.6, 319.7, 402, 404, 319.8; 62/382, 440; 74/89.17, 56, 89.18, 395, 396, 74/399, 405, 352, 354; 192/20; 318/264–267, 318/272, 286, 466–469

See application file for complete search history.

(56) References Cited

U.S. PATENT DOCUMENTS

| | | | | | |
|---|---|---|---|---|---|
| 2,175,086 | A * | 10/1939 | Mitchell | 38/59 |
| 2,503,146 | A * | 4/1950 | Anketell | 74/405 |
| 2,888,839 | A * | 6/1959 | Waldrich | 74/665 Q |
| 2,895,781 | A | 7/1959 | Latter et al. | |
| 3,021,719 | A * | 2/1962 | Conrad, Jr. | 477/19 |
| 3,028,209 | A * | 4/1962 | Hinkel et al. | 312/319.7 |
| 3,601,234 | A * | 8/1971 | Ingraham | 477/15 |
| 3,943,786 | A * | 3/1976 | Mills | 74/384 |
| 4,131,776 | A * | 12/1978 | Ehrenberger | 200/500 |
| 4,484,649 | A * | 11/1984 | Kennedy et al. | 180/216 |
| 4,635,763 | A * | 1/1987 | Omata | 188/268 |
| 5,087,107 | A * | 2/1992 | Fumanelli | 312/333 |
| 5,101,714 | A | 4/1992 | Grandi | |
| 5,564,767 | A | 10/1996 | Strepek | |
| 5,603,237 | A * | 2/1997 | Bohman et al. | 72/444 |
| 5,746,489 | A * | 5/1998 | Moon | 312/223.3 |
| 5,794,381 | A * | 8/1998 | Rizkovsky | 49/139 |
| 6,053,099 | A * | 4/2000 | Gruber | 100/35 |
| 6,533,375 | B2 | 3/2003 | Fulterer et al. | |
| 6,540,311 | B2 * | 4/2003 | Canedy et al. | 312/114 |
| 6,547,236 | B1 * | 4/2003 | Yip et al. | 271/115 |
| 6,571,808 | B2 | 6/2003 | Todd | |
| 6,732,552 | B2 | 5/2004 | Kim et al. | |
| 2001/0013745 | A1 * | 8/2001 | Fulterer et al. | 312/319.5 |
| 2003/0122519 | A1 * | 7/2003 | Huber et al. | 318/646 |
| 2006/0013677 | A1 | 1/2006 | Oh et al. | |
| 2007/0262686 | A1 * | 11/2007 | Ji | 312/402 |
| 2009/0302728 | A1 * | 12/2009 | Rotter et al. | 312/404 |

OTHER PUBLICATIONS

U.S. Appl. No. 12/347,373, filed Dec. 31, 2008.

* cited by examiner

*Primary Examiner* — James O Hansen
*Assistant Examiner* — Matthew Ing
(74) *Attorney, Agent, or Firm* — Fay Sharpe LLP

(57) ABSTRACT

An appliance, such as a refrigerator, includes a drawer mounted within a cabinet for movement between an opened position and a closed position. A driving mechanism, including an electric motor and a transmission assembly, connects to the drawer for driving the drawer between the opened position and the closed position. The driving mechanism has an engaged state wherein the drawer is power driven by the driving mechanism between the opened and closed positions and a disengaged state wherein the drawer is manually movable between the opened and closed positions.

12 Claims, 10 Drawing Sheets

POWERED DRAWER FOR AN APPLIANCE

BACKGROUND

The present disclosure generally relates to appliances, such as refrigerators, and more particularly relates to a powered drawer in an appliance. In one embodiment, a powered refrigerator drawer includes a drawer mounted within a refrigerator for movement between a closed position and an open position, and a driving mechanism connected to the drawer for driving the drawer between the closed and open positions, wherein the driving mechanism has an engaged state in which the drawer is power driven by the driving mechanism between the closed and open positions and a disengaged state in which the drawer is manually movable between the closed and opened positions. The powered drawer will be described with particular reference to this embodiment, but it is to be appreciated that it is also amenable to other like applications (e.g., used in another type of appliance).

By way of background, appliances, including refrigerators, sometimes include a drawer. A popular refrigerator configuration includes a bottom mounted freezer drawer that slides in and out for easy access. However, with the drawer being at the bottom of the refrigerator cabinet, bending and a significant pulling force are required for opening the drawer. This is met with some difficulty for certain people, such as elderly people. In addition, the drawer typically includes a gasket for sealing thereof when in its closed position. The sealing by the gasket causes an increased force to be needed for opening the drawer to overcome sealing of the gasket.

Others have sometimes attempted to overcome the foregoing problems and others by modifying the freezer drawer. For example, some freezer drawers employ a pivoting action to overcome the sealing of the gasket to allow the drawer to be more easily opened. Other freezer drawers are moved over a slight incline upward as the drawer is opened such that the drawer is biased to its fully closed position by gravitational force to facilitate full closure of the freezer drawer. Of course, such an incline, even when slight, causes yet further force to be applied to the drawer when opening it.

SUMMARY

According to one aspect, a powered refrigerator drawer is provided. More particularly, in accordance with this aspect, the powered refrigerator drawer includes a drawer mounted within a refrigerator for movement between a closed position and an opened position. A driving mechanism is connected to the drawer for driving the drawer between the closed position and the opened position. The driving mechanism has an engaged state wherein the drawer is power driven by the driving mechanism between the closed and the opened positions and a disengaged state wherein the drawer is manually movable between the closed and the opened positions.

According to another aspect, an appliance having a powered drawer is provided. More particularly, in accordance with this aspect, the appliance includes a drawer mounted within a cabinet for movement between an opened position and a closed position. An electric motor selectively connects to the drawer for powered driving of the drawer between the opened position and the closed position. A transmission assembly selectively connects the electric motor to the drawer and converts rotational power from the motor to linear movement of the powered drawer.

According to yet another aspect, a refrigerator having a powered freezer drawer is provided. More particularly, in accordance with this aspect, the refrigerator having a powered freezer drawer includes a drawer mounted within the refrigerator cabinet for movement between and opened position and a closed position and a motor selectively connected to the drawer for selective power driving of the drawer. A transmission assembly selectively connects the motor to the drawer for powered driving of the drawer.

DETAILED DESCRIPTION

Figure 1:
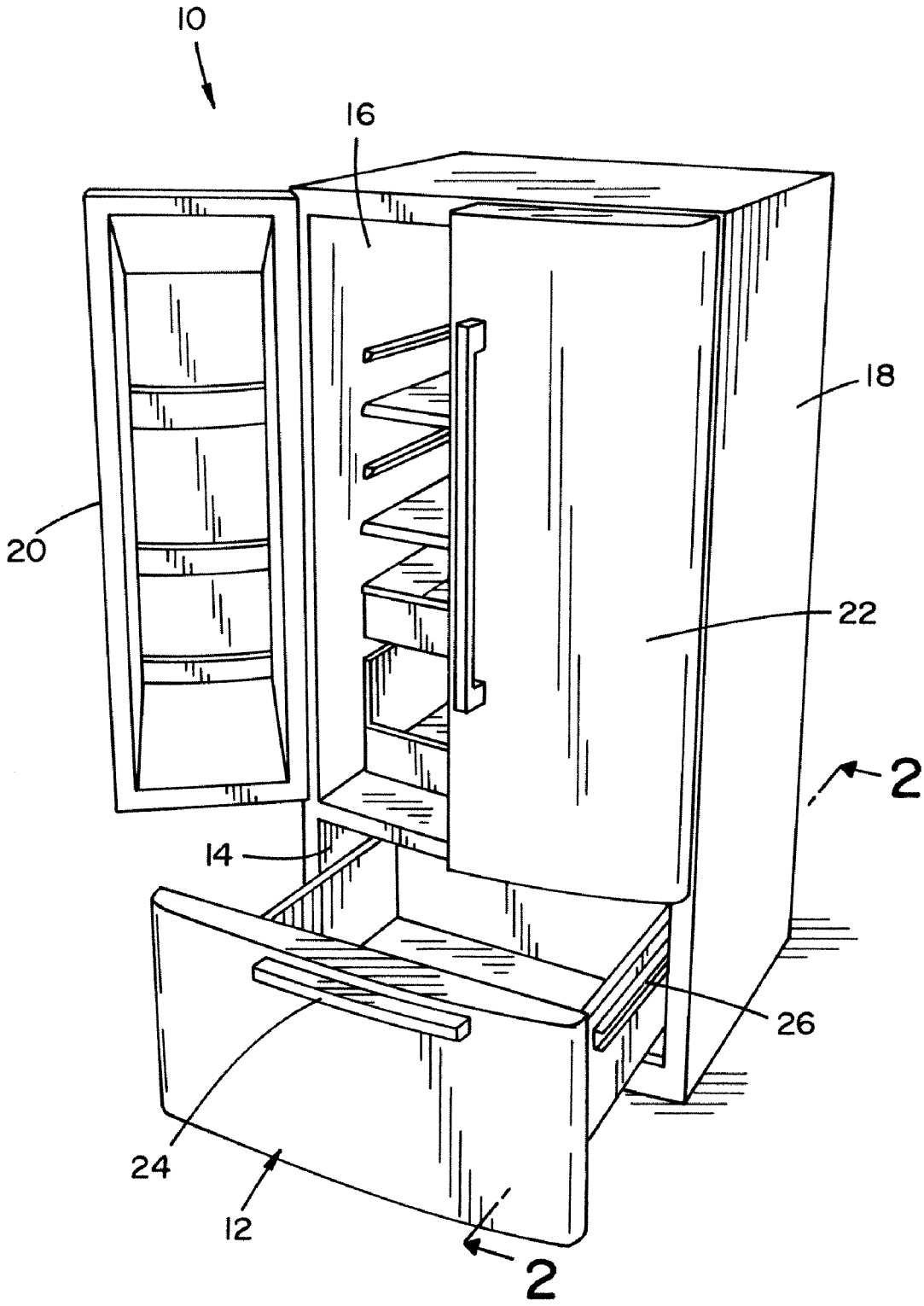
FIG. 1 is a perspective view of a refrigerator having a powered drawer.

Referring now to the drawings wherein the showings are for purposes of illustrating one or more exemplary embodiments, FIG. 1 shows an appliance 10 having a powered drawer 12. In the embodiment illustrated in FIG. 1, the appliance 10 is a refrigerator, but it is to be appreciated that the appliance could be any other type of appliance in which a drawer, such as drawer 12, is provided (e.g., a washer, a dryer, etc.). When mounted within a refrigerator, the drawer 12 can be referred to as a powered refrigerator drawer. The illustrated refrigerator 10 is a bottom mount refrigerator in that it has a freezer compartment 14 disposed at a bottom of the refrigerator below a fresh food storage compartment 16. More particularly, the refrigerator 10 includes a refrigerator cabinet or housing 18 which defines the fresh food refrigerated storage compartment 16 and the freezer compartment 14 (i.e., the refrigerated component 16 is housed by the cabinet 18 above the refrigerator compartment 14). The drawer 12 is mounted within the refrigerator 10, particularly within the cabinet 18 and in the freezer storage compartment 14, for movement between a closed position and an opened position (the position illustrated in FIG. 1). In this configuration, the drawer 12 can be referred to as a bottom mount freezer drawer. Doors 20, 22 can be disposed in side-by-side relation over the fresh food storage compartment 16 for providing access thereto. In addition, the drawer 12 can include a handle 24 for facilitating manual movement of the drawer 12 between its opened and closed positions.

Figure 2:
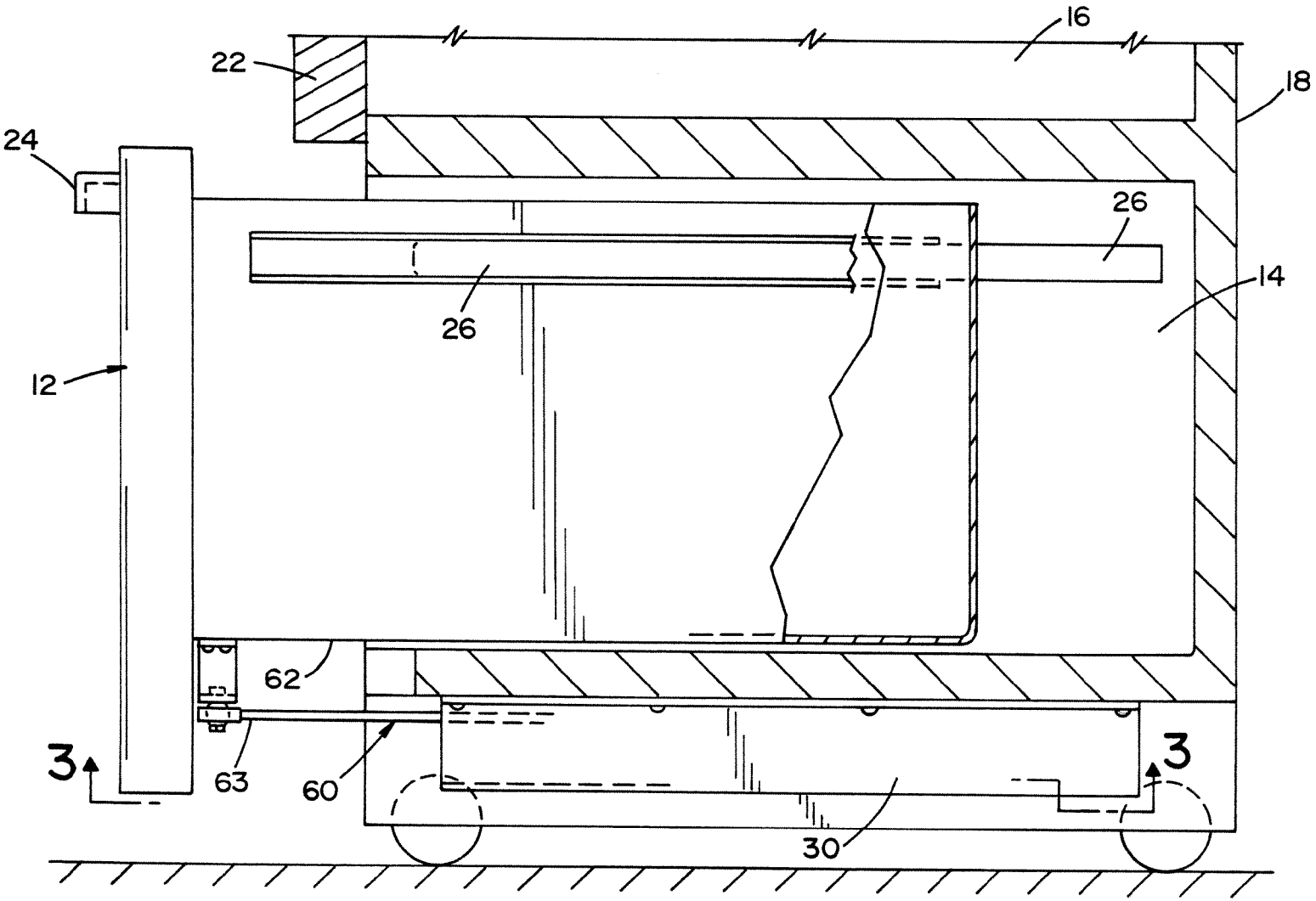
FIG. 2 is a schematic cross sectional view of the refrigerator taken along the line 2-2 of FIG. 1.

With additional reference to FIG. 2, movement of the drawer 12 can be guided by slides 26 as is known and understood by those skilled in the art. As will be described in more detail below, a driving mechanism connected to the drawer 12 can be provided for powered driving of the drawer 12 between its open and closed positions (i.e., the driving mechanism drives the drawer 12 to its open position, its closed position or any intermediate position). In the illustrated embodiment, the driving mechanism is housed within an underside casing 30 disposed immediately below the freezer compartment 14 (i.e., the driving mechanism can be located entirely outside the refrigerated space). The driving mechanism employs a prime mover, such as an electric motor, to reduce the effort required to open and close the drawer, an effort that is otherwise substantial. The driving mechanism can have an engaged state wherein the drawer 12 is power driven by the driving mechanism between the opened and closed positions and a disengaged state wherein the drawer 12 is manually movable between the opened and closed positions.

The driving mechanism 28 includes a motor 32, such as an electric motor, and a transmission assembly 34 that selectively connects the electric motor 32 to the drawer 12 for powered driving of the drawer 12 between the open and closed positions, and converts rotational power from the motor 32 to linear movement of the powered drawer 12. Particularly, the transmission assembly 34 converts rotational power from the motor 32 to linear movement of the drawer 12 when the driving mechanism 28 is in its engaged state. As will be described below, operation of the motor 32 in a first rotational direction with the driving mechanism 28 in its engaged state causes the drawer 12 to move in a first linear direction, such as toward its open position, and operation of the motor 32 in a second, opposite rotational direction with the driving mechanism 28 in its engaged state causes the drawer 12 to move in a second, opposite linear direction, such as toward its closed position.

Figure 3:
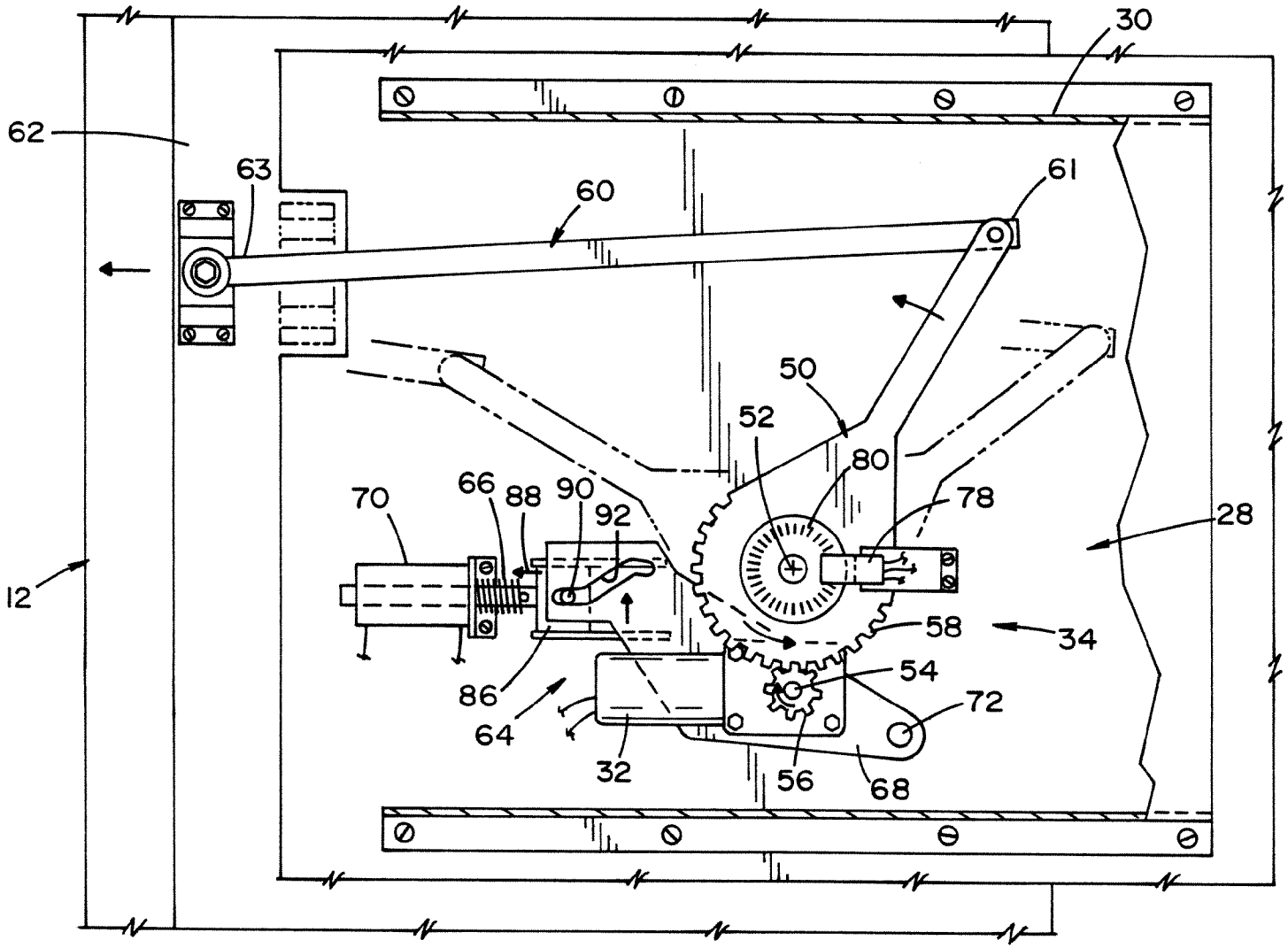
FIG. 3 is a schematic cross sectional view of an underside casing disposed below the powered drawer taken along the line 3-3 of FIG. 1, the underside casing housing a driving mechanism including a crank and lever assembly for powered opening/closing of the powered drawer.
Figure 4:
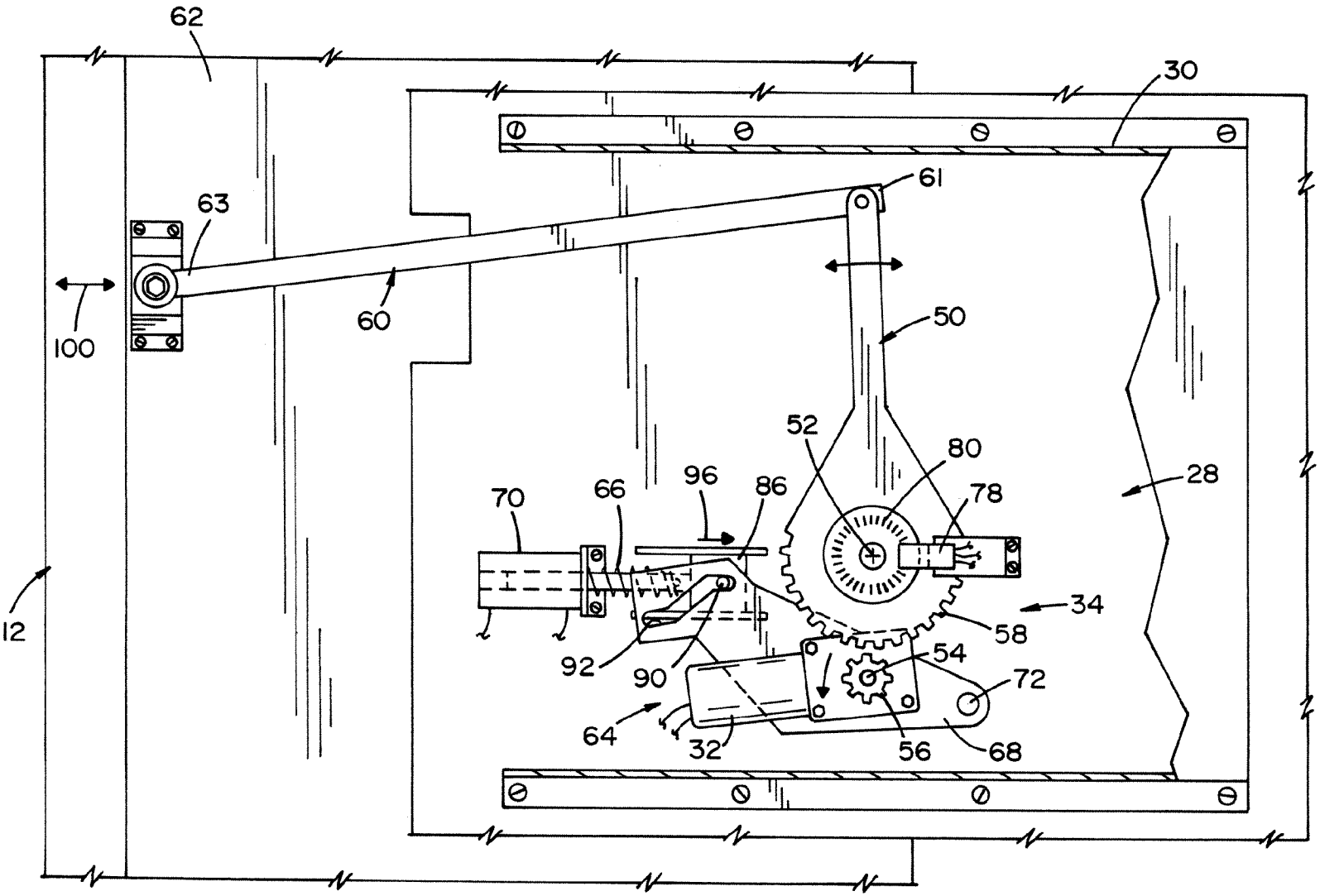
FIG. 4 is a schematic cross sectional view of the driving mechanism of FIG. 3 shown in a disengaged state to allow manual opening and closing of the powered drawer.

Turning to FIGS. 3 and 4, the transmission assembly 34 is shown according to one embodiment as including a crank and lever assembly for powered opening/closing of the drawer 12. More particularly, in the embodiment illustrated in FIGS. 3 and 4, the transmission assembly 34 includes a crank lever 50 rotatable by the motor 32 about a first crank lever axis 52. More particularly, the motor 32 can include an output shaft 54 having a driven gear 56 mounted thereto for co-rotation therewith. Teeth of the gear 56 are selectively meshingly engaged with a toothed section 58 of the crank lever 50. The illustrated transmission assembly 34 further includes a rod 60 having one end 61 pivotally connected to the crank lever 50 at a location spaced apart from the first crank lever axis 52 and a second end 63 pivotally connected to the drawer 12, such as to an underside 62 of the drawer (see FIG. 2). Rotation of the crank lever 50 about the axis 52 in one rotatable direction (a first direction, such as counterclockwise in FIG. 3) by the motor 56 translates through the rod 60 to linear movement of the drawer 12 in a first linear direction, such as toward the open position. Rotation of the crank lever 50 in another, opposite direction (a second direction, such as clockwise in FIG. 3) by the motor 32 translates through the rod 60 to linear movement of the drawer 12 in a second linear direction, such as toward the closed position. In the illustrated arrangement, rotation of the shaft 54 and the gear 56 occurs in a rotatable direction opposite that of the crank lever 50 about the axis 52.

The transmission assembly 34 can also include a clutch mechanism 64 that mechanically connects the motor 32 to the drawer 12 for powered driving of the drawer when the driving mechanism 28 is in its engaged state and mechanically disconnects the motor 32 from the drawer 12 for manual moving of the drawer when the driving mechanism 28 is in the disengaged state. As will be described in further detail below, the clutch mechanism 64 can include a bias mechanism 66 for urging the clutch mechanism 64 toward mechanically disconnecting the motor 32 from the drawer 12. The clutch mechanism 64 can further include a clutch plate 68 movable between a first position (e.g., the position shown in FIG. 3) in which the clutch plate 68 connects the motor 32 to the drawer 12 and a second position (e.g., the position shown in FIG. 4) in which the clutch plate 68 disconnects the motor 32 from the drawer 12. The bias mechanism 66 urges the clutch plate 68 toward the second position (i.e., the position shown in FIG. 4). In the embodiment illustrated in FIGS. 3 and 4, the motor 32 is fixed on the clutch plate 68 and the bias mechanism 66 includes a spring that urges the clutch plate 68 with the motor 32 fixed thereon toward the second position. The clutch mechanism 64 can also include a solenoid actuator 70 that, when powered, mechanically connects the motor 32 to the drawer 12 overcoming the urging of the spring 66, and, when depowered, mechanically disconnects the motor 32 from the drawer 12.

More specifically, in the embodiment illustrated in FIGS. 3 and 4, the clutch mechanism 64 serves to selectively meshingly engage the toothed driven gear 56 with the toothed section 58 of the crank lever 50. The clutch plate 68 illustrated in FIGS. 3 and 4 is a pivotally mounted clutch plate on which the motor 32 is fixedly mounted. Thus, the clutch plate 68 is pivotally movable about pivot axis 72 between its first position in which the driven gear 56 meshingly engages the toothed section 58 of the crank lever 50 (again, the position shown in FIG. 3) and its second position in which the toothed gear 56 disengages the toothed section 58 of the crank lever 50 (again, the position illustrated in FIG. 4). The solenoid actuator 70, when actuated, overcomes the urging of the clutch plate 68 toward its second position and moves the clutch plate 68 toward the first position. When the clutch plate 68 is in its first position illustrated in FIG. 3, the driving mechanism 28 is in its engaged state. When the clutch plate 68 is in its second position of FIG. 4, the driving mechanism 28 is in its disengaged state.

An encoder 78 can be provided in conjunction with the drive assembly 28 for providing feedback as to the position of the drawer 12. In an exemplary arrangement, the encoder 78 is disposed adjacent the crank lever 50 on which an encoder wheel or portion 80 is fixed.

In operation when power is available (i.e., there is no power outage), the solenoid actuator 70 moves the clutch plate 68 to its first position shown in FIG. 3 wherein the driven gear 56 is meshingly engaged with the toothed section 58 of the crank lever 50. More particularly, in the embodiment illustrated in FIGS. 3 and 4, actuation of the solenoid actuator 70 causes a piston 86 to be moved in a first direction (such as the direction indicated by arrow 88) against and overcoming the urging of the spring 66. The piston 86 can include a pin 90 received in a shaped slot 92 through the clutch plate 68. The shape of the slot 92 and its orientation relative to the clutch plate axis 72 can be used to move the clutch plate 68 and the gear 56 carried thereon into engagement with the toothed section 58 of the crank lever 50.

Thus, when desired, the solenoid actuator 70 can be actuated to move the clutch plate 68 and cause the gear 56 to meshingly engage with the crank lever 50. Then, the motor 32 can cause the driven gear 56 to rotate in the first rotatable direction (e.g., clockwise in FIG. 3) causing the drawer 12 to move toward its open position. Alternatively, the motor 32 can cause the driven gear 56 to rotate in the second rotatable direction (e.g., counterclockwise in FIG. 3) to cause the drawer 12 to move toward its closed position.

Without power (e.g., due to a power outage) the solenoid 70 is no longer actuated and the spring 66 urges or moves the piston 86 as indicated by arrow 96 in FIG. 4. This causes the clutch plate 68 via the pin 90 and slot 92 to move back toward or to its second position wherein the gear 56 is disengaged from the toothed section 58 of the crank lever 50, as shown in FIG. 4. With the gear 56 disengaged from the toothed section 58 of the crank lever 50, the drawer 12 can be manually moved to and between its opened and closed positions as indicated by arrow 100.

Figure 5:
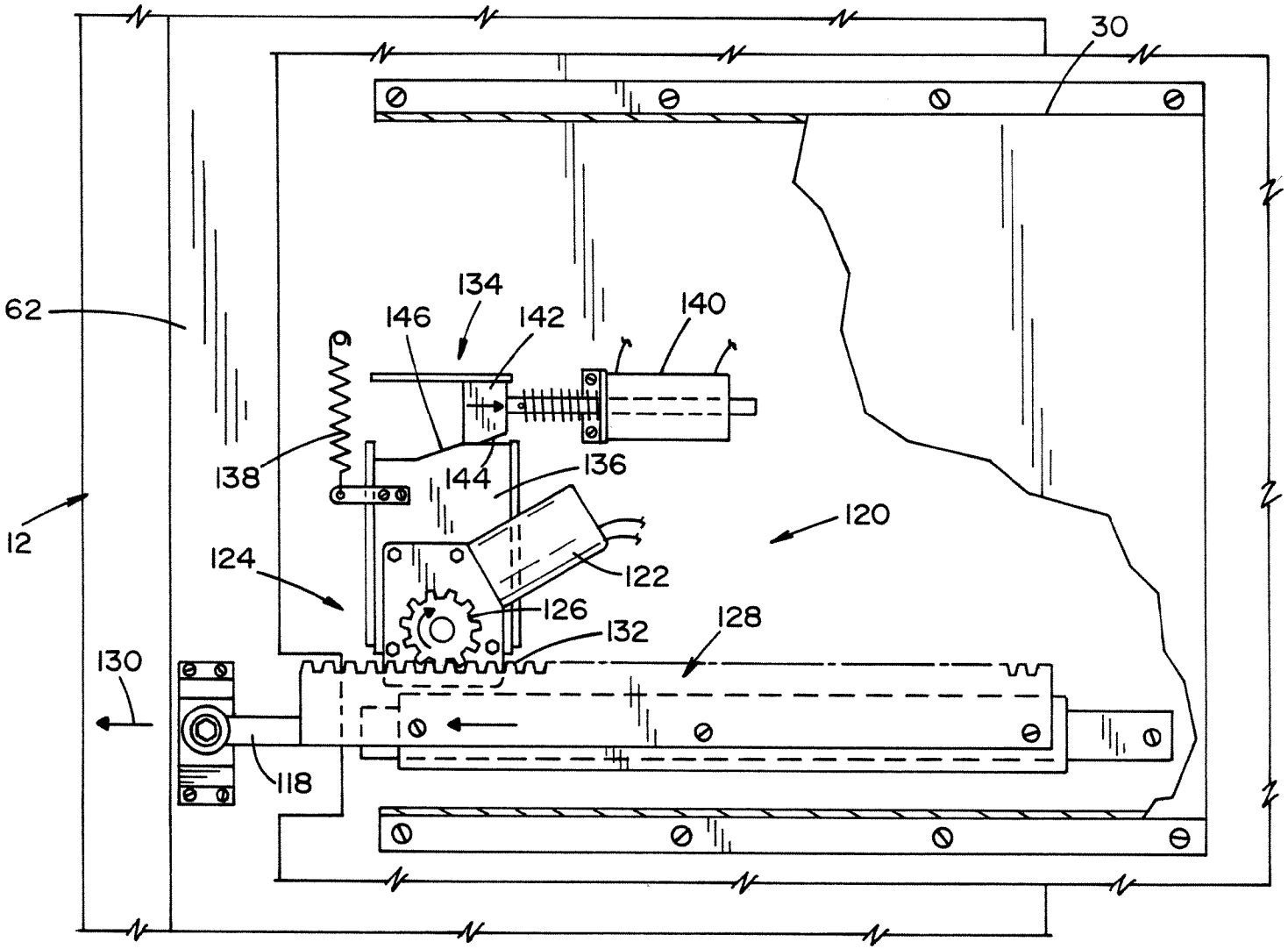
FIG. 5 is a schematic cross sectional view similar to FIG. 3, but showing a driving mechanism including a rack and driven assembly for powered opening/closing of the powered drawer.
Figure 6:
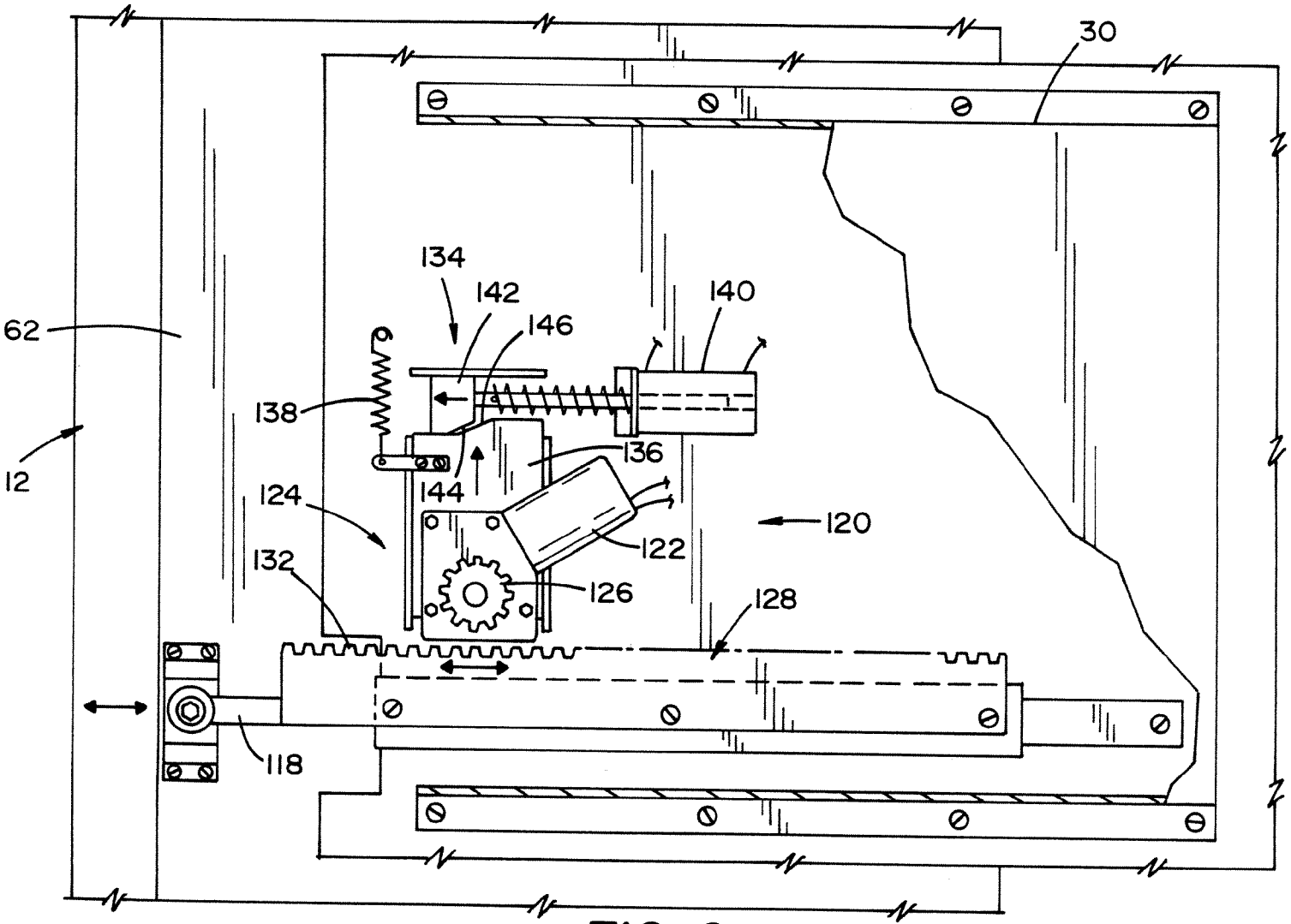
FIG. 6 is a schematic cross sectional view of the driving mechanism of FIG. 5 shown in a disengaged state to allow manual opening and closing of the powered drawer.

With reference to FIGS. 5 and 6, an alternate driving mechanism 120 is illustrated that employs a rack and driven assembly for powered opening/closing of the drawer 12. Except as indicated herein, the driving mechanism 120 operates the same or similar as the driving mechanism 28 described in association with FIGS. 3 and 4. More particularly, the driving mechanism 120 includes an electric motor 122 and a transmission assembly 124 for selectively connecting the electric motor 122 to the drawer 12 and converting rotational power from the motor 122 to linear movement of the drawer 12. As illustrated, the transmission assembly 124 of FIGS. 5 and 6 includes a driven gear 126 rotatable by the motor 122 and a rack gear 128 fixedly connected to the drawer (such as through rod 118) and selectively meshingly engaged with the gear 126 such that, when meshingly engaged, rotation of the gear 126 in one rotatable direction (a first rotatable direction, such as clockwise) by the motor 122 translates through the rack gear 128 to linear movement of the drawer 12 in the first linear direction toward the opened position, as indicated by arrow 130. Rotation of the driven gear 126 in another, opposite direction (a second rotatable direction, such as counterclockwise) by the motor 122 translates through the rack gear 128 to linear movement of the drawer 12 in the second linear direction toward the drawer closed position. The rack gear 128, or at least the teeth 132 thereof, can extend a distance at least equal to a travel distance of the drawer between the open and closed positions.

The transmission assembly 124 can further include a clutch mechanism 134 for selectively meshingly engaging the gear 126 driven by the motor 122 with the rack gear 128, particularly teeth 132 of the rack gear. In the embodiment illustrated, the clutch mechanism 134 includes a slidably disposed clutch plate 136 on which the motor 122 is fixedly mounted. The clutch plate 136 is movable between a first position (the position shown in FIG. 5) in which the gear 126 meshingly engages with the rack gear 128 and a second position (the position shown in FIG. 6) in which the gear 126 disengages from the rack gear 128. In the arrangement illustrated, the clutch plate 136 travels in a direction approximately normal relative to a direction of travel of the rack gear 128. As shown, the clutch plate 136 is urged toward its second position (i.e., the disengaged position of FIG. 6). In particular, a biasing mechanism, such as spring 138 can be used to urge the clutch plate 136 toward its second position.

The clutch mechanism 134 can further include a solenoid actuator 140 that, when actuated, overcomes the urging of the clutch plate 136 by the spring 138 and moves the clutch plate 136 toward its first position shown in FIG. 5. In one exemplary construction, the solenoid actuator 140 can have a spring bias piston 142 generally urged to an expanded position as shown in FIG. 6. Actuation of the solenoid actuator 140 causes the piston 142 to move as indicated in FIG. 5. The piston 142 can have a tapered surface 144 that acts on a corresponding tapered surface 146 of the clutch plate 136 so as to move the clutch plate 136 to its first position when the solenoid 140 is actuated. When the solenoid 140 is not actuated, the piston 142 moves as shown in FIG. 6, which allows the clutch plate 136 to move toward its second position, wherein the gear 126 is disengaged from the rack gear 128 and manual movement of the drawer 12 is allowed. Like the driving mechanism 28, the driving mechanism 120 is considered in its engaged state when the clutch plate 136 is in the first position and in its disengaged state when the clutch plate 136 is in its second position. Though not illustrated, an encoder can be used in conjunction with the drive assembly 120 of FIGS. 5 and 6 to indicate via an electronic signal the position of the drawer 12.

Figure 7:
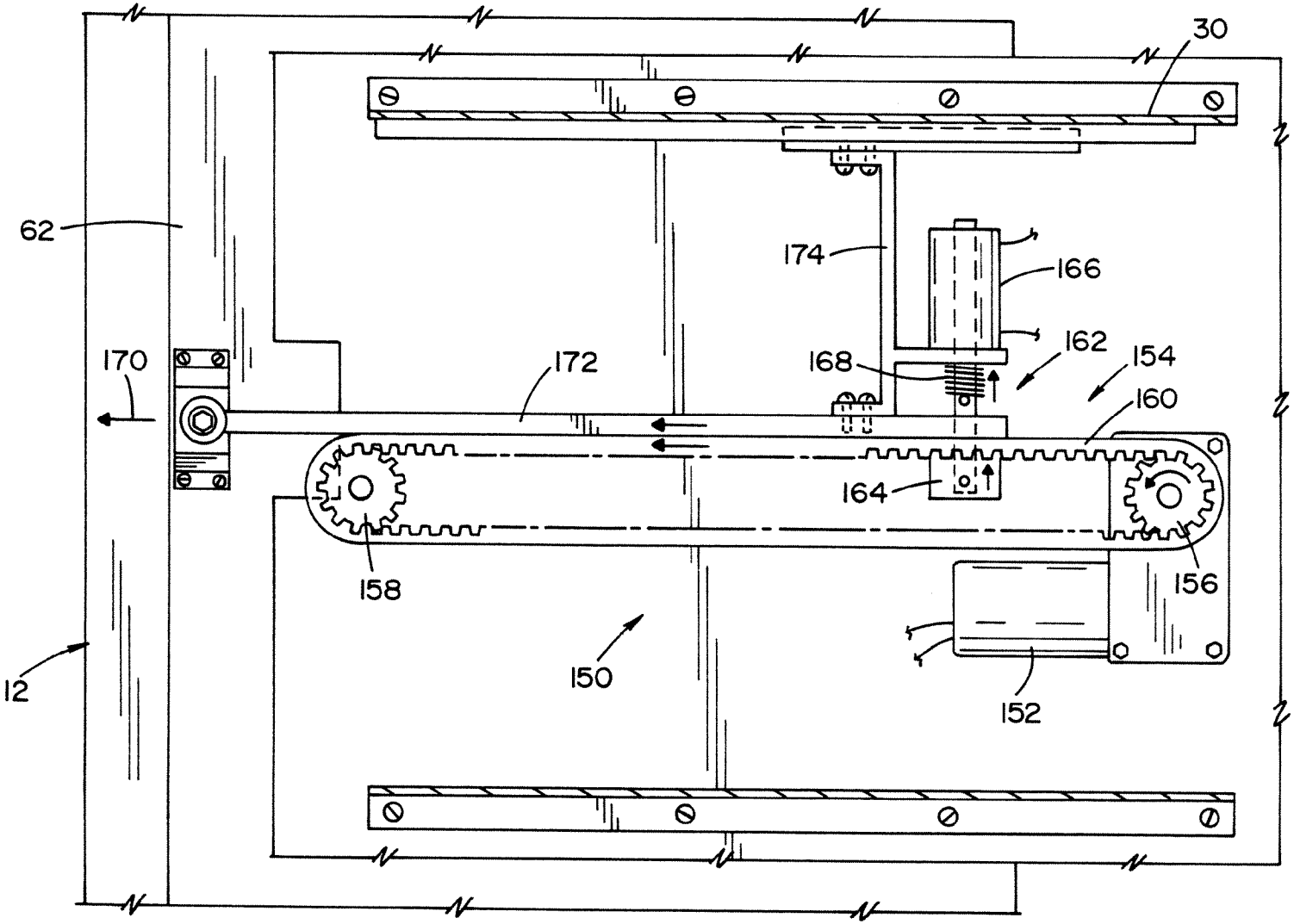
FIG. 7 is a schematic cross sectional view similar to FIG. 3, but showing a driving mechanism including a belt and pulley arrangement for powered opening/closing of the powered drawer.
Figure 8:
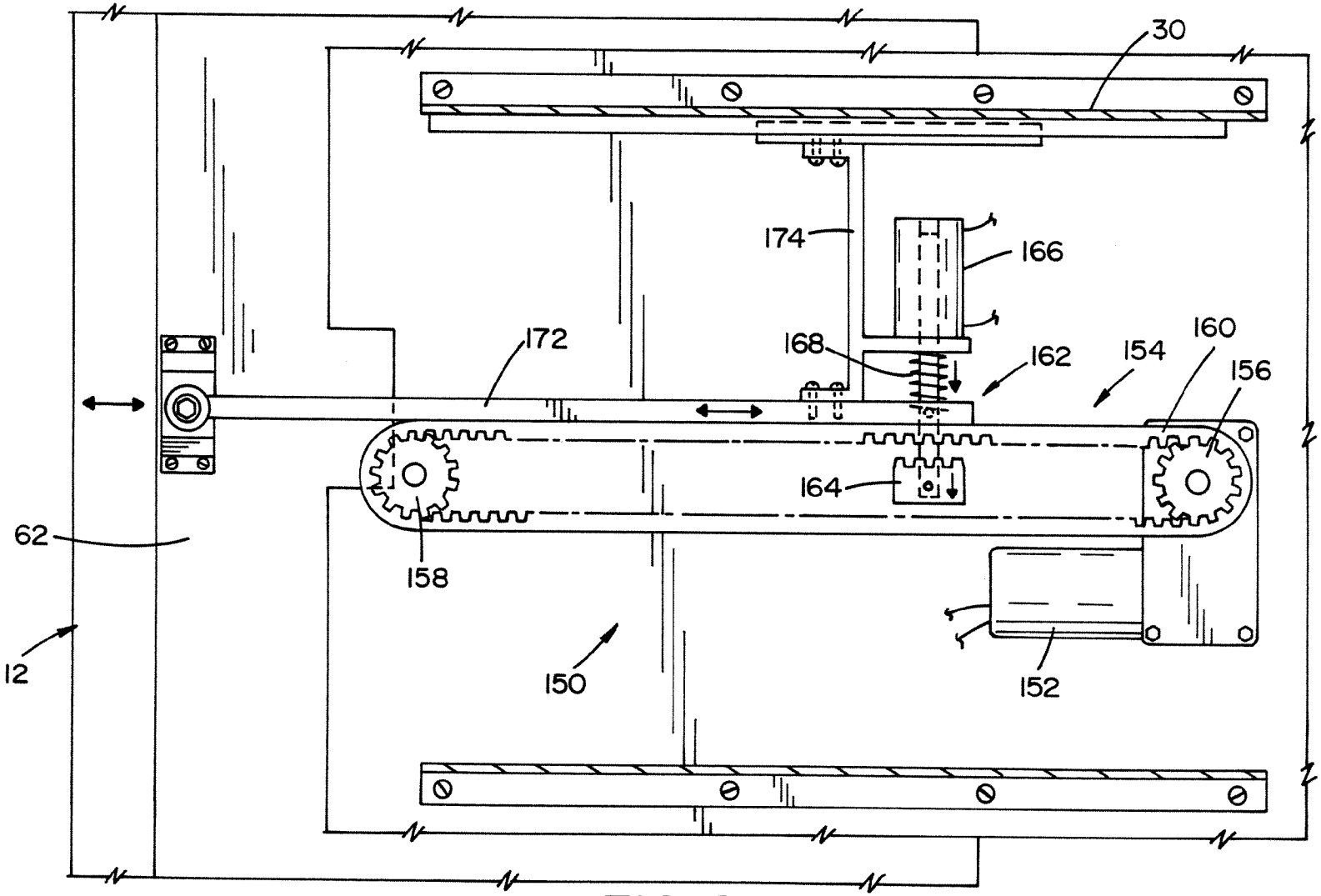
FIG. 8 is a schematic cross sectional view of the driving mechanism of FIG. 7 shown in a disengaged state to allow manual opening and closing of the powered drawer.

With reference now to FIGS. 7 and 8, another alternate driving mechanism 150 is shown employing a belt and pulley arrangement for power opening/closing of the drawer 12. Except as indicated herein, the driving mechanism 150 is the same and operates the same as the driving mechanism 28. Like the driving mechanism 28, the driving mechanism 150 includes an electric motor 152 and a transmission assembly 154 for selectively connecting the electric motor 152 to the drawer 12 and converting rotational power from the motor 152 to linear movement of the drawer 12. The transmission assembly 154 includes a driven gear or sprocket 156 rotatably driven by the motor 152, an idler gear or sprocket 158 spaced apart from the gear 156 and a toothed belt 160 meshingly engaged with the gear 156 and the idler gear 158. In particular, the gear 156 is coupled to the motor 152 so as to be driven thereby and the spaced apart idler gear 158 is spaced apart a distance greater than a drawer opening distance (i.e., a distance between the fully closed position of the drawer 12 and the fully opened position). The drawer 12 is selectively connected to the toothed belt 160 such that, when connected, rotation of the gear 156 in one rotatable direction (a first rotatable direction, such as counterclockwise) by the motor 152 translates through the belt 160 to linear movement of the drawer 12 in the first linear direction (i.e., toward its opened position) and rotation of the gear 156 in another, opposite direction (a second rotatable direction, such as clockwise) by the motor 152 translates through the belt 160 to linear movement of the drawer 12 in the second linear direction (i.e., toward its closed position).

For selectively connecting the drawer 12 to the belt 160, the transmission assembly 154 includes a clutch mechanism 162, including a toothed clutch plate 164 and a solenoid actuator 166. The tooth clutch plate 164 can be fixedly secured to the drawer 12 (such as through rod 172 and bracket 174) for selectively engaging to the toothed belt 160. More particularly, the toothed clutch plate 164 is movable between a first position (the position shown in FIG. 7) in which the toothed clutch plate 164 is connected to the belt 160 for movement therewith and a second position (the position shown in FIG. 8) in which the toothed clutch plate 164 disconnects and is disengaged from the belt 160. The toothed clutch plate 164 is urged to its second position shown in FIG. 8 by a biasing mechanism, such as spring 168. The solenoid actuator 166, when actuated, overcomes the urging of the clutch plate 164 toward its second position by the spring 168 and moves the clutch plate 164 toward and to its first position of FIG. 7 such that teeth of the clutch plate 164 meshingly engage with teeth of the toothed belt 160.

When the toothed clutch plate 164 is engaged with the toothed belt 160, the clutch plate 164 travels linearly along the straight portion of the belt 160 as the belt is rotated by the gears 156, 158. This in turn drives the drawer 12 between its open and closed positions. For example, with the solenoid actuator 166 causing the clutch plate 164 to engage the belt 160, rotation of the gear 156 in the first rotatable direction (counterclockwise) causes the belt rotate in the first rotatable direction (counterclockwise) about the gears 156, 158. Such rotation of the belt 160 with the clutch plate 164 secured thereto transfers to the drawer 12 and causes the drawer to move toward its open position as indicated by arrow 170. When depowered (such as due to a power outage), the solenoid actuator 166 releases the clutch plate 164 such that it disengages from the belt 160 as shown in FIG. 8. While disengaged from the belt, the clutch plate 164 and thus the drawer 12 are manually movable between the open and closed positions.

Figure 9:
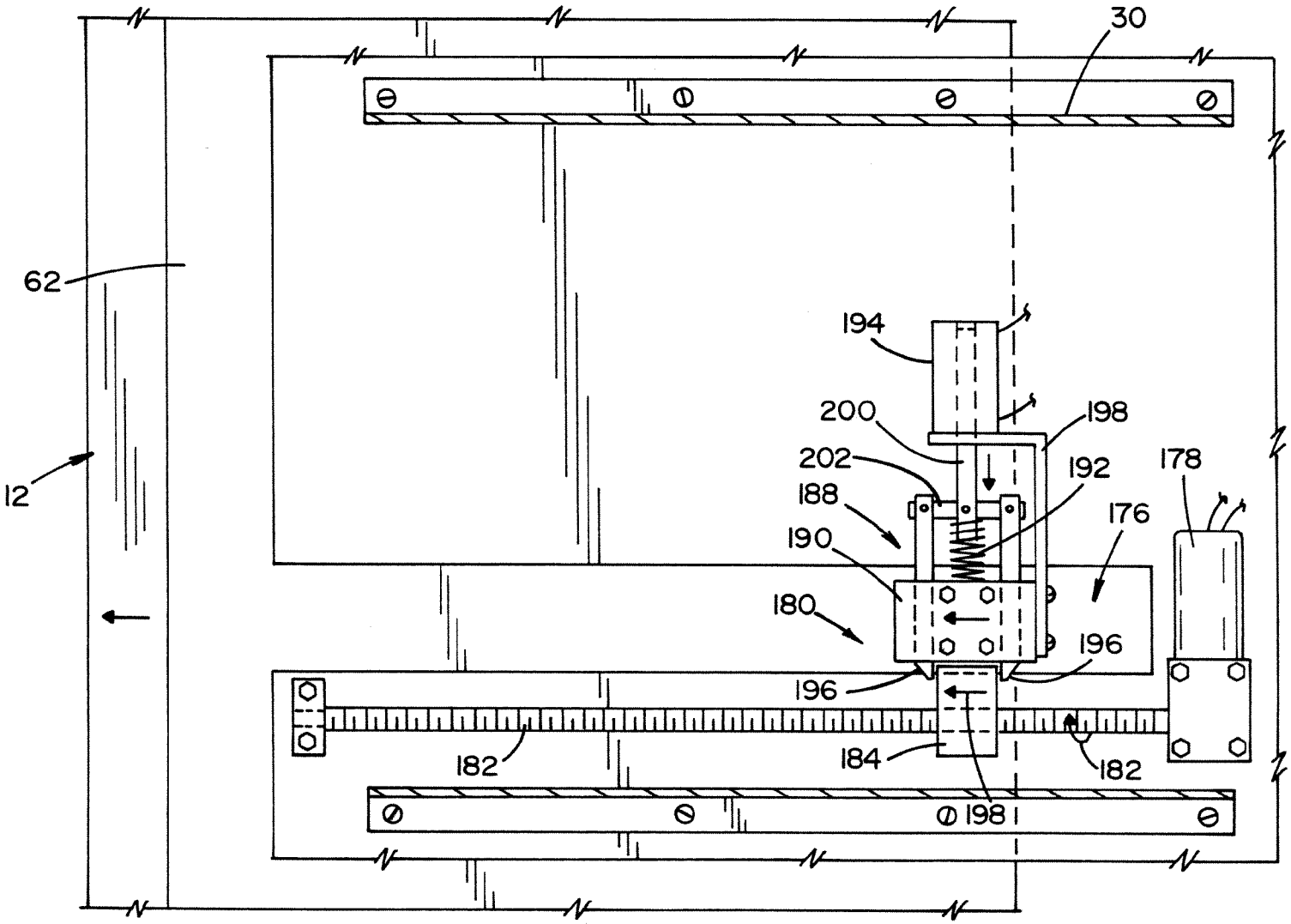
FIG. 9 is a schematic cross sectional view similar to FIG. 3, but showing a driving mechanism including an elongated screw and nut arrangement for powered opening/closing of the powered drawer.
Figure 10:
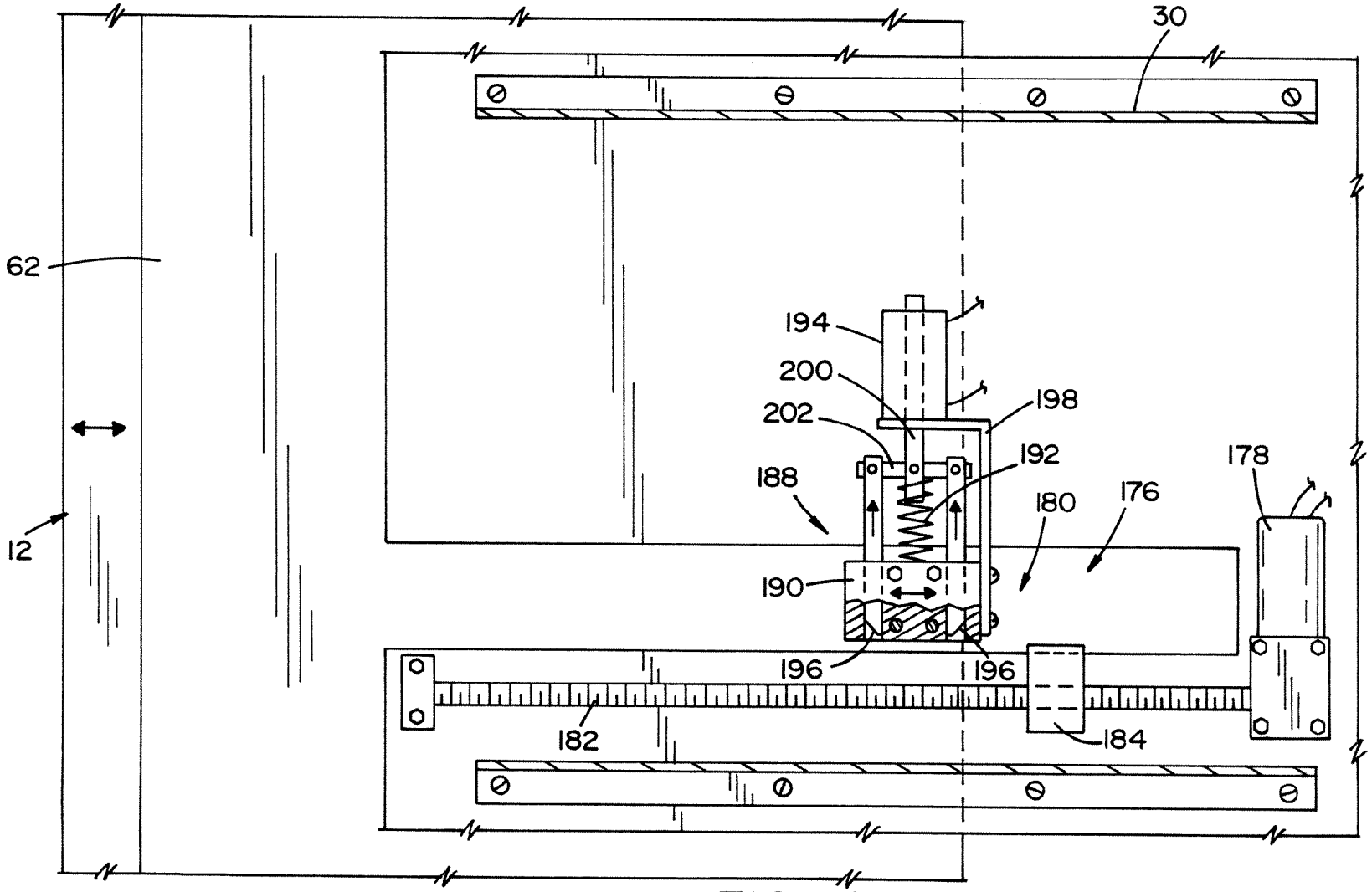
FIG. 10 is a schematic cross sectional view of the driving mechanism of FIG. 9 shown in a disengaged state to allow manual opening and closing of the powered drawer.

With reference now to FIGS. 9 and 10, yet another alternative driving mechanism is shown including an elongated screw and nut arrangement for powered opening/closing of the drawer 12. As will be understood and appreciated by those skilled in the art, the driving arrangement 176 illustrated in FIGS. 9 and 10 can be substituted for the driving mechanism 28 and thus the driving mechanism 176 can be used with the refrigerator 10 or some other appliance. Except as indicated herein, the driving mechanism 176 operates like the driving mechanism 28. More particularly, the driving mechanism 176 includes an electric motor 178 that is selectively connected to the drawer 12 for power driving thereof and a transmission assembly 180 for selectively connecting the motor 178 to the drawer 12 and converting rotational power from the motor 178 to linear movement of the drawer 12.

The transmission assembly 180 includes an elongated screw 182 rotatably driven by the motor 178 and a nut 184 threadedly disposed on the elongated screw 182 for linear movement therealong as the elongated screw 182 is rotatably driven by the motor 178. The elongated screw 182 can have a length or a threaded length at least equal to a maximum travel distance expected of the drawer 12. As will be described in more detail below, the drawer 12 is selectively connected to the nut 184 such that, when connected, rotation of the elongated screw 182 in one rotatable direction (a first rotatable direction, such as indicated by arrow 186) by the motor 178 translates through the nut 184 to linear movement of the drawer 12 in the first linear direction (i.e., toward the open position) and rotation of the elongated screw 182 in another, opposite direction (a second rotatable direction, such as a direction opposite the arrow 186) by the motor 176 translates through the nut 184 to linear movement of the drawer 12 in the second linear direction (i.e., toward the closed position).

For selectively connecting the drawer 12 to the nut 184, the transmission assembly 180 includes a clutch mechanism 188. The clutch mechanism 188 includes a clutch plate or device formed of movable camming arms 196 secured to the drawer 12 through plate 190 and bracket 198 for selectively connecting the drawer 12 to the nut 184. The arms 196 are movable between a first position (the position shown in FIG. 9) in which the arms 196 are connectable to the nut 184 for movement therewith and a second position (the position shown in FIG. 10) in which the arms 196 are disconnected from the nut 184 and movable independent relative to the nut. The arms 196 are urged toward the second position by a biasing mechanism, such a spring 192. The clutch mechanism 188 further includes a solenoid actuator 194 for moving the arms 196 to its first position against the urging of the spring 192. More particularly, the solenoid actuator 194, when actuated, overcomes the urging of the arms 196 toward the second position by the spring 192 and moves the arms toward the first position.

When in the first position, the arms 196 are not necessarily connected to the nut 184. Rather, the arms 196 connect to the nut 184 when in the first position and the plate 190 and the nut 184 are axially aligned along the elongated screw 182. The arms 196 can include tapered camming surfaces at their distal ends between which the nut 184 can be locked. More particularly, when the plate 190 is not aligned with the nut 184 and the arms are in the first position, movement of the drawer 12 and/or driven movement of the nut 184 will lock the plate 190 to the nut 184 via the arms 196. In addition, the arms 196 can be pivotally connected to actuator arm 200 via brace arm 202 to further facilitate connection of the arms 196 and the plate 190 to the nut 184.

In operation, with the arms 196 in the first position and connected to the nut 184 as shown in FIG. 9, rotation of the elongated screw 182 as indicated by arrow 186 causes the nut 184 to travel along the screw 182 as indicated by arrow 198 by the locking arrangement between the arms 196 and the nut 184 that is facilitated by the plate 190. The linear movement of the nut 184 translates through the arms 196 and the plate 190 to the drawer 12 such that the drawer 12 is moved toward its open position. Reversing the motor 178 and causing the elongated screw 182 to rotate in the second rotatable direction causes the nut 184 and the arms 196 to move in a reverse direction and move the drawer 12 toward its closed position. Should actuation of the solenoid actuator 194 be terminated (e.g., by a manual override or a power outage) the spring 192 will move the arms 196 to the second position shown in FIG. 10 wherein the arms are disengaged from the nut 184 and the drawer 12 is manually movable.

In any configuration, the drawer 12 being driven by a driving mechanism (e.g., driving mechanism 28) reduces the effort required in opening and closing the drawer 12. While the driving mechanism 28 has been described and shown as being installed on the illustrated refrigerator 10 (and could be substituted by one of the driving mechanisms 120, 150, or 176), it should be appreciated and understood by those of skill in the art that a driving mechanism could be an add-on feature added to an existing refrigerator.

The exemplary embodiment or embodiments have been described with reference to preferred embodiments. Obviously, modifications and alterations will occur to others upon reading and understanding the preceding detailed description. It is intended that the exemplary embodiments be construed as including all such modifications and alterations insofar as they come within the scope of the appended claims or the equivalents thereof.

What is claimed is:

1. A powered drawer, comprising:

a drawer mounted for movement between a closed position and an open position; and a driving mechanism connected to said drawer for driving of said drawer between said closed position and said open position, said driving mechanism having an engaged state wherein said drawer is power driven by said driving mechanism between said closed and said open positions and a disengaged state wherein said drawer is manually movable between said closed and said open positions, said driving mechanism including:

an electric motor, and a transmission assembly comprising an output shaft of a motor shaft including a toothed gear selectively meshingly engaged with a toothed section of a driven member to move said driven member in said a first direction to open said drawer and a second direction to close said drawer, said transmission assembly including a clutch mechanism for selectively meshingly engaging said toothed gear with said toothed section of said driven member, the clutch mechanism comprising a movably mounted clutch plate on which said electric motor is fixedly mounted, said clutch plate movable between a first position in which said toothed gear meshingly engages said toothed section of said driven member and a second position in which said toothed gear disengages said toothed section of said driven member, said clutch plate urged toward said second position; and a solenoid actuator that, when actuated, overcomes said urging of said clutch plate toward said second position and moves said clutch plate toward said first position, said driving mechanism in said engaged state when said clutch plate is in said first position and in said disengaged state when said clutch plate is in said second position.

2. The powered drawer of claim 1 wherein said transmission assembly converts rotational power from said electric motor to linear movement of said powered drawer when said driving mechanism is in said engaged state, operation of said electric motor in a first rotational direction with said driving mechanism in said engaged state causing said drawer to move in a first linear direction and operation of said electric motor in a second, opposite rotational direction with said driving mechanism in said engaged state causing said drawer to move in a second, opposite linear direction.

3. The powered drawer of claim 2 wherein said transmission assembly includes:

a crank lever rotatable by said electric motor about a first crank lever axis; and a rod having one end pivotally connected to said crank lever at a location spaced apart from said first crank lever axis and a second end pivotally connected to said drawer, rotation of said crank lever in one rotatable direction by said electric motor translates through said rod to linear movement of said drawer in said first linear direction and rotation of said crank lever in another, opposite direction by said electric motor translates through said rod to linear movement of said drawer in said second linear direction.

4. The powered drawer of claim 2 wherein said said clutch mechanism mechanically connects said electric motor to said drawer for powered driving of said drawer when said driving mechanism is in said engaged state and mechanically disconnects said electric motor from said drawer for manual moving of said drawer when said driving mechanism is in said disengaged state, said clutch mechanism including a bias mechanism for urging said clutch mechanism toward mechanically disconnecting said electric motor from said drawer.

5. The powered drawer of claim 4 wherein said bias mechanism urges said clutch plate toward said second position.

6. The powered drawer of claim 5 wherein said electric motor is fixed on said clutch plate and said bias mechanism includes a spring that urges said clutch plate with said electric motor fixed thereon toward said second position.

7. The powered drawer of claim 4 wherein said a solenoid actuator when powered, mechanically connects said electric motor to said drawer overcoming said urging of said bias mechanism, and, when depowered, mechanically disconnects said electric motor from said drawer.

8. An appliance having a powered drawer, comprising:

a drawer mounted within a cabinet for movement between an open position and a closed position;

an electric motor selectively connected to said drawer for powered driving of said drawer between said open position and said closed position; and a transmission assembly selectively connecting said electric motor to said drawer and converting rotational power from said motor to linear movement of said powered drawer, said transmission assembly comprising an output shaft of a motor shaft including a toothed gear selectively meshingly engaged with a toothed section of a driven member to move said driven member in said a first direction to open said drawer and a second direction to close said drawer, said transmission assembly including a clutch mechanism for selectively meshingly engaging said toothed gear with said toothed section of said driven member, the clutch mechanism comprising a movably mounted clutch plate on which said electric motor is fixedly mounted, said clutch plate movable between a first position in which said toothed gear meshingly engages said toothed section of said driven member and a second position in which said toothed gear disengages said toothed section of said driven member, said clutch plate urged toward said second position; and a solenoid actuator that, when actuated, overcomes said urging of said clutch plate toward said second position and moves said clutch plate toward said first position, said driving mechanism in said engaged state when said clutch plate is in said first position and in said disengaged state when said clutch plate is in said second position.

9. The appliance of claim 8 wherein the solenoid actuator when powered, mechanically connects said electric motor to said drawer.

10. The appliance of claim 8 wherein said drawer is a bottom mount freezer drawer and said cabinet is a refrigerator cabinet housing a refrigerated compartment above said bottom mount freezer drawer.

11. The appliance of claim 10 wherein said drive mechanism is located entirely outside any refrigerated space of said refrigerator cabinet.

12. A refrigerator having a powered freezer drawer, comprising:

a drawer mounted within a refrigerator cabinet for movement between an open position and a closed position;

a motor selectively connected to said drawer for selective powered driving of said drawer; and selectively connecting said motor to said drawer for powered driving of said drawer said transmission assembly comprising an output shaft of a motor shaft including a toothed gear selectively meshingly engaged with a toothed section of a driven member to move said driven member in said a first direction to open said drawer and a second direction to close said drawer, said transmission assembly including a clutch mechanism for selectively meshingly engaging said toothed gear with said toothed section of said driven member, the clutch mechanism comprising a movably mounted clutch plate on which said electric motor is fixedly mounted, said clutch plate movable between a first position in which said toothed gear meshingly engages said toothed section of said driven member and a second position in which said toothed gear disengages said toothed section of said driven member, said clutch plate urged toward said second position; and a solenoid actuator that, when actuated, overcomes said urging of said clutch plate toward said second position and moves said clutch plate toward said first position, said driving mechanism in said engaged state when said clutch plate is in said first position and in said disengaged state when said clutch plate is in said second position.

* * * * *